US008616160B2

(12) United States Patent
Suzuki

(10) Patent No.: US 8,616,160 B2
(45) Date of Patent: Dec. 31, 2013

(54) COOLING APPARATUS FOR WATER-COOLED ENGINE AND METHOD OF CONTROLLING COOLING APPARATUS FOR WATER-COOLED ENGINE

(75) Inventor: Tatsuaki Suzuki, Okazaki (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 232 days.

(21) Appl. No.: 13/048,317

(22) Filed: Mar. 15, 2011

(65) Prior Publication Data

US 2011/0220042 A1 Sep. 15, 2011

(30) Foreign Application Priority Data

Mar. 15, 2010 (JP) ..... 2010-057691

(51) Int. Cl.
*F01P 7/02* (2006.01)

(52) U.S. Cl.
USPC ..... 123/41.12; 123/41.05; 123/41.11; 123/41.63; 123/41.56

(58) Field of Classification Search
USPC ..... 123/41.12, 41.01, 41.05, 41.1, 41.11, 123/41.63, 41.56
See application file for complete search history.

(56) References Cited

U.S. PATENT DOCUMENTS 4,823,744 A * 4/1989 Omura ..... 123/41.12
4,977,743 A * 12/1990 Aihara et al. ..... 60/605.3
6,739,290 B2 * 5/2004 Iwasaki et al. ..... 123/41.05
6,772,060 B2 * 8/2004 McCauley et al. ..... 701/104
6,772,714 B2 * 8/2004 Laird et al. ..... 123/41.12
7,267,086 B2 * 9/2007 Allen et al. ..... 123/41.44
2004/0206099 A1 * 10/2004 Kim ..... 62/178
2006/0180102 A1 * 8/2006 Braun et al. ..... 123/41.12
2006/0202808 A1 * 9/2006 Obradovich ..... 340/425.5
2009/0025661 A1 * 1/2009 Itoga et al. ..... 123/41.12
2009/0241865 A1 * 10/2009 Stramecki ..... 123/41.12

FOREIGN PATENT DOCUMENTS

JP 63-158533 U 10/1988
JP 8049537 A 2/1996
JP 08200067 A 8/1996
JP 2000345842 A 12/2000

OTHER PUBLICATIONS

JP-08-20067 machine translation, originally published 2006.*
Japanese Office Action issued Feb. 21, 2012 in Japanese Patent Application No. 2010-057691 and English language translation thereof.

* cited by examiner

*Primary Examiner* — Noah Kamen
*Assistant Examiner* — Long T Tran
(74) *Attorney, Agent, or Firm* — Gifford, Krass, Sprinkle, Anderson & Citkowski, P.C.

(57) ABSTRACT

A cooling apparatus for a water-cooled engine includes a radiator that cools coolant that has been circulated in the engine; a radiator fan that delivers air to the radiator; a determination portion that determines whether the engine is operated under a high load; and a setting portion. If the determination portion determines that the engine is operated under a high load, the setting portion sets an operation rate of the radiator fan at a time point at which the determination portion determines that the engine is operated under a high load, to a value higher than a normal operation rate at the same coolant temperature as a coolant temperature at the time point.

8 Claims, 4 Drawing Sheets

COOLING APPARATUS FOR WATER-COOLED ENGINE AND METHOD OF CONTROLLING COOLING APPARATUS FOR WATER-COOLED ENGINE

CROSS-REFERENCE TO RELATED APPLICATION

This application claims priority to Japanese Patent Application No. 2010-057691 filed on Mar. 15, 2010, which is incorporated herein by reference in its entirety including the specification, drawings and abstract.

BACKGROUND OF THE INVENTION

1. Field of the Invention

The invention relates to a cooling apparatus for a water-cooled engine, and a method of controlling a cooling apparatus for a water-cooled engine. More particularly, the invention relates to improvement in a control structure of a cooling apparatus, for improving restartability of an engine when the engine is restarted immediately after the engine has been operated under a high load.

2. Description of the Related Art

A water-cooled engine is cooled by circulating coolant in a water jacket formed in a cylinder head and a cylinder block, and delivering air to a radiator to cool the coolant whose temperature has been increased by heat received from the engine. In many water-cooled engines, for example, in the water-cooled engine provided in a vehicle, a coolant temperature is detected, and when the coolant temperature is equal to or higher than a set value, a radiator fan is operated to deliver air to the radiator, so that efficiency of cooling the engine is increased.

When the engine is stopped immediately after a vehicle has traveled on an upward slope or at a high speed and therefore the engine has been operated under a high load for a long period, a temperature around the engine may sharply increase due to the stop of the radiator fan. In this situation, the temperature of fuel may increase, and accordingly, vapor may be generated in a delivery pipe. Thus, when the engine is restarted in a high-temperature condition, the vapor in the delivery pipe may be sucked into an injector. As a result, fuel may not be appropriately injected, and the startability of the engine and idling stability after the engine start may deteriorate. Therefore, when the engine is restarted in a high temperature condition, it is necessary to quickly decrease the temperatures of oil and coolant for the engine, in order to ensure the startability and idling stability.

Thus, Japanese Patent Application Publication No. 08-200067 (JP-A-08-200067) describes a technology in which if a coolant temperature and an intake air temperature in an engine are high at the time of engine start, and it is determined that the engine is restarted in a high temperature condition, a set value of the coolant temperature related to the operation of a radiator fan is made lower than a normal threshold value, so that the operation of the engine is stabilized after the restart of the engine in a high temperature condition.

In the above-described technology, it is possible to quickly decrease the temperatures of oil and coolant for the engine after the start of the engine. Therefore, it is possible to increase the stability of the operation of the engine after the restart of the engine in a high temperature condition. However, when the radiator fan is operated after the start of the engine, it takes a certain time to decrease the temperatures of oil and coolant for the engine, and therefore, the effect of improving the startability of the engine at the time of restart in a high temperature condition is limited.

SUMMARY OF THE INVENTION

The invention provides a cooling apparatus for a water-cooled engine, and a method of controlling a cooling apparatus for a water-cooled engine, which effectively improve startability of the engine when the engine is restarted immediately after the engine has been operated under a high load.

A first aspect of the invention relates to a cooling apparatus for a water-cooled engine, which includes a radiator that cools coolant that has been circulated in the engine; and a radiator fan that delivers air to the radiator. When employing the cooling apparatus for a water-cooled engine, which includes the radiator and the radiator fan, if the engine is stopped immediately after the engine has been operated under a high load, a temperature around the engine may sharply increase due to the stop of the radiator fan. If the engine is restarted in this situation, fuel vapor may be generated, and therefore, the startability may deteriorate.

Thus, according to the first aspect of the invention, the cooling apparatus for a water-cooled engine includes a determination portion that determines whether the engine is operated under a high load; and a setting portion. If the determination portion determines that the engine is operated under a high load, the setting portion sets an operation rate of the radiator fan at a time point at which the determination portion determines that the engine is operated under a high load, to a value higher than a normal operation rate at the same coolant temperature as a coolant temperature at the time point. In this case, when the engine is operated under a high load, even if the coolant temperature is low, the radiator fan is operated at a high operation rate. Thus, when there is a possibility that the engine will be restarted in a high temperature condition after the engine is operated under a high load, it is possible to decrease in advance the temperatures of oil and coolant for the engine during the operation of the engine. Accordingly, with the above-described configuration, it is possible to effectively improve the startability of the engine when the engine is restarted immediately after the engine has been operated under a high load.

It is conceivable to operate the radiator fan after the engine is stopped after the engine has been operated under a high load. In this case as well, it may be possible to decrease in advance the temperatures of oil and coolant before the start of the engine, and therefore, it may be possible to improve the restartability. However, when the water-cooled engine is in a stopped state, operations of an alternator and a generator are also stopped. If the radiator fan is operated in this situation, there is a concern that the engine cannot be restarted due to a decrease in a power-feeding ability, which is caused by discharge of a battery. In contrast, in the above-described configuration, such a concern is eliminated, because the radiator fan is operated at a high operation rate during the operation of the engine.

A second aspect of the invention relates to a cooling apparatus for a water-cooled engine, which includes a radiator that cools coolant that has been circulated in the engine; a radiator fan that delivers air to the radiator; and a radiator fan control portion that operates the radiator fan on a condition that a temperature of the coolant for the engine is equal to or higher than a threshold value. According to the second aspect of the invention, the cooling apparatus for a water-cooled engine includes a determination portion that determines whether the engine is operated under a high load; and a setting portion. If the determination portion determines that the engine is operated under a high load, the setting portion sets the threshold value to a value lower than a normal threshold value, at a time point at which the determination portion determines that the engine is operated under a high load.

With this configuration, when the engine is operated under a high load, the threshold value of the coolant temperature is set to a value lower than the normal threshold value. As a result, when the engine is operated under a high load, the operation of the radiator fan is started at a low coolant temperature. Thus, when there is a possibility that the engine will be restarted in a high temperature condition after the engine is operated under a high load, it is possible to decrease in advance the temperatures of oil and coolant for the engine during the operation of the engine. Accordingly, with the above-described configuration, it is possible to effectively improve the startability of the engine when the engine is restarted immediately after the engine has been operated under a high load.

A third aspect of the invention relates to a cooling apparatus for a water-cooled engine, which includes a radiator that cools coolant that has been circulated in the engine; and a radiator fan that delivers air to the radiator. According to the third aspect of the invention, the cooling apparatus for a water-cooled engine includes a determination portion that determines whether the engine is operated under a high load; and a setting portion. If the determination portion determines that the engine is operated under a high load, the setting portion sets a target cooling temperature of the coolant to a value lower than a normal target cooling temperature, at a time point at which the determination portion determines that the engine is operated under a high load.

With this configuration, when the engine is operated under a high load, the target cooling temperature of the coolant is set to a value lower than the normal target cooling temperature. That is, in this case, the radiator fan is operated to cool the coolant for the engine until the coolant temperature reaches the target cooling temperature lower than the normal target cooling temperature. Thus, when there is a possibility that the engine will be restarted in a high temperature condition after the engine is operated under a high load, it is possible to decrease in advance the temperatures of oil and coolant for the engine during the operation of the engine. Accordingly, with the above-described configuration, it is possible to effectively improve the startability of the engine when the engine is restarted immediately after the engine has been operated under a high load.

In the above-described aspects, the determination portion may determine that the engine is operated under a high load when an accumulated amount of air taken into the engine during a predetermined determination period is equal to or larger than a predetermined determination value.

According to a fourth aspect of the invention, a cooling apparatus for a water-cooled engine includes a radiator that cools coolant that has been circulated in the engine; a radiator fan that delivers air to the radiator; and a controller that operates the radiator fan on a condition that a temperature of the coolant for the engine is equal to or higher than a threshold value. The controller sets the threshold value so that the threshold value decreases as a load of the engine increases.

With this configuration, when the engine is operated under a high load, the threshold value of the coolant temperature is set to a value lower than a normal threshold value. As a result, when the engine is operated under a high load, the operation of the radiator fan is started at a low coolant temperature. Thus, when there is a possibility that the engine will be restarted in a high temperature condition after the engine is operated under a high load, it is possible to decrease in advance the temperatures of oil and coolant for the engine during the operation of the engine. Accordingly, with the above-described configuration, it is possible to effectively improve the startability of the engine when the engine is restarted immediately after the engine has been operated under a high load.

A fifth aspect of the invention relates to a method of controlling a cooling apparatus for a water-cooled engine, which includes a radiator that cools coolant that has been circulated in the engine; and a radiator fan that delivers air to the radiator. The method includes determining whether the engine is operated under a high load; setting a coolant temperature threshold value, which is related to a control of operation of the radiator fan, to a value lower than a normal threshold value, at a time point at which it is determined that the engine is operated under a high load, if it is determined that the engine is operated under a high load; and operating the radiator fan on a condition that a temperature of the coolant is equal to or higher than the coolant temperature threshold value that is set to the value lower than the normal threshold value, if it is determined that the engine is operated under a high load.

BRIEF DESCRIPTION OF THE DRAWINGS

The foregoing and further objects, features and advantages of the invention will become apparent from the following description of example embodiments with reference to the accompanying drawings, wherein like numerals are used to represent like elements and wherein.

DETAILED DESCRIPTION OF EMBODIMENTS

Figure 1:
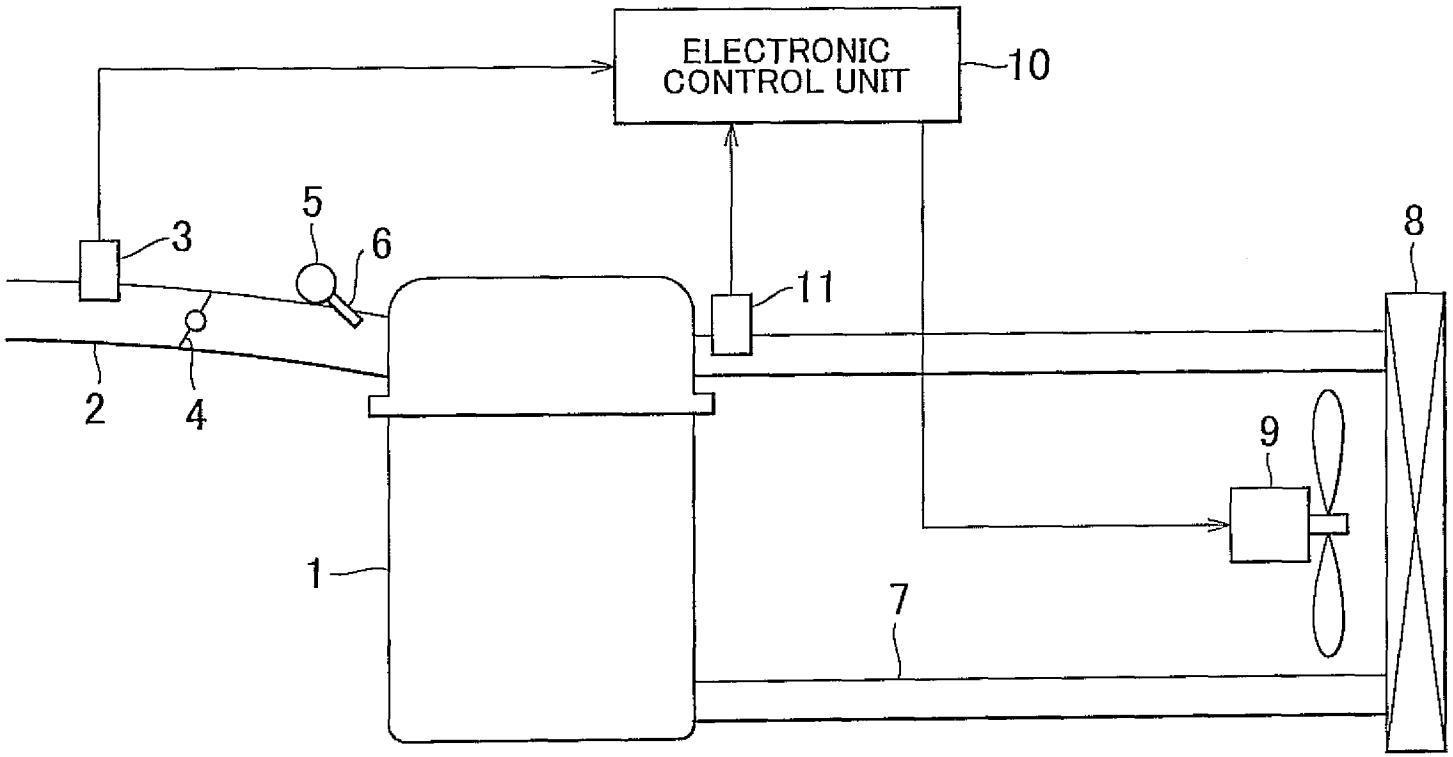
FIG. 1 is a schematic diagram schematically showing the configuration of an entire cooling apparatus for a water-cooled engine according to an embodiment of the invention.

Hereinafter, a cooling apparatus for a water-cooled engine according to an embodiment of the invention will be described in detail with reference to FIG. 1 to FIG. 3. FIG. 1 shows the configuration of the entire cooling apparatus for a water-cooled engine according to the embodiment. As shown in FIG. 1, in an intake passage 2 of a water-cooled engine 1 to which the cooling apparatus according to the embodiment is applied, an airflow meter 3, a throttle valve 4, and an injector 6 are provided. The airflow meter 3 detects an intake air amount. The throttle valve 4 adjusts the intake air amount. The injector 6 injects fuel accumulated in a delivery pipe 5, into intake air. The water-cooled engine 1 is connected to a coolant circulation passage 7. Coolant, which has passed through a water jacket formed in the water-cooled engine 1, is circulated through the coolant circulation passage 7. The coolant circulation passage 7 is provided with a radiator 8 in which the coolant is cooled through heat exchange between the coolant and surrounding air. An electric radiator fan 9, which delivers air to the radiator 8, is provided to face the radiator 8.

The operation of the radiator fan 9 is controlled by an electronic control unit 10. The electronic control unit 10 receives a detection signal from the airflow meter 3, and a detection signal from a coolant sensor 11 that detects a coolant temperature that is the temperature of the coolant.

In the above-described configuration in the embodiment, the electronic control unit 10 controls the operation of the radiator fan 9 according to the coolant temperature. More specifically, if the coolant temperature is equal to or higher than a threshold value A, the electronic control unit 10 operates the radiator fan 9, and if the coolant temperature is lower than the threshold value A, the electronic control unit 10 stops the radiator fan 9.

During the operation of the water-cooled engine 1, the electronic control unit 10 determines whether the water-cooled engine 1 is operated under a high load. In the embodiment, the electronic control unit 10 determines whether the water-cooled engine 1 is operated under a high load, based on whether an accumulated amount of air taken into the water-cooled engine 1 (hereinafter, referred to as "an accumulated intake air amount") during a predetermined determination period is equal to or larger than a predetermined determination value B. The electronic control unit 10 variably sets the threshold value A related to the control of the operation of the radiator fan 9, according to the result of the determination. More specifically, if it is determined that the water-cooled engine 1 is operated under a high load, the electronic control unit 10 sets the threshold value A to a value lower than a normal threshold value, at the time point at which it is determined that the water-cooled engine 1 is operated under a high load.

Figure 2:
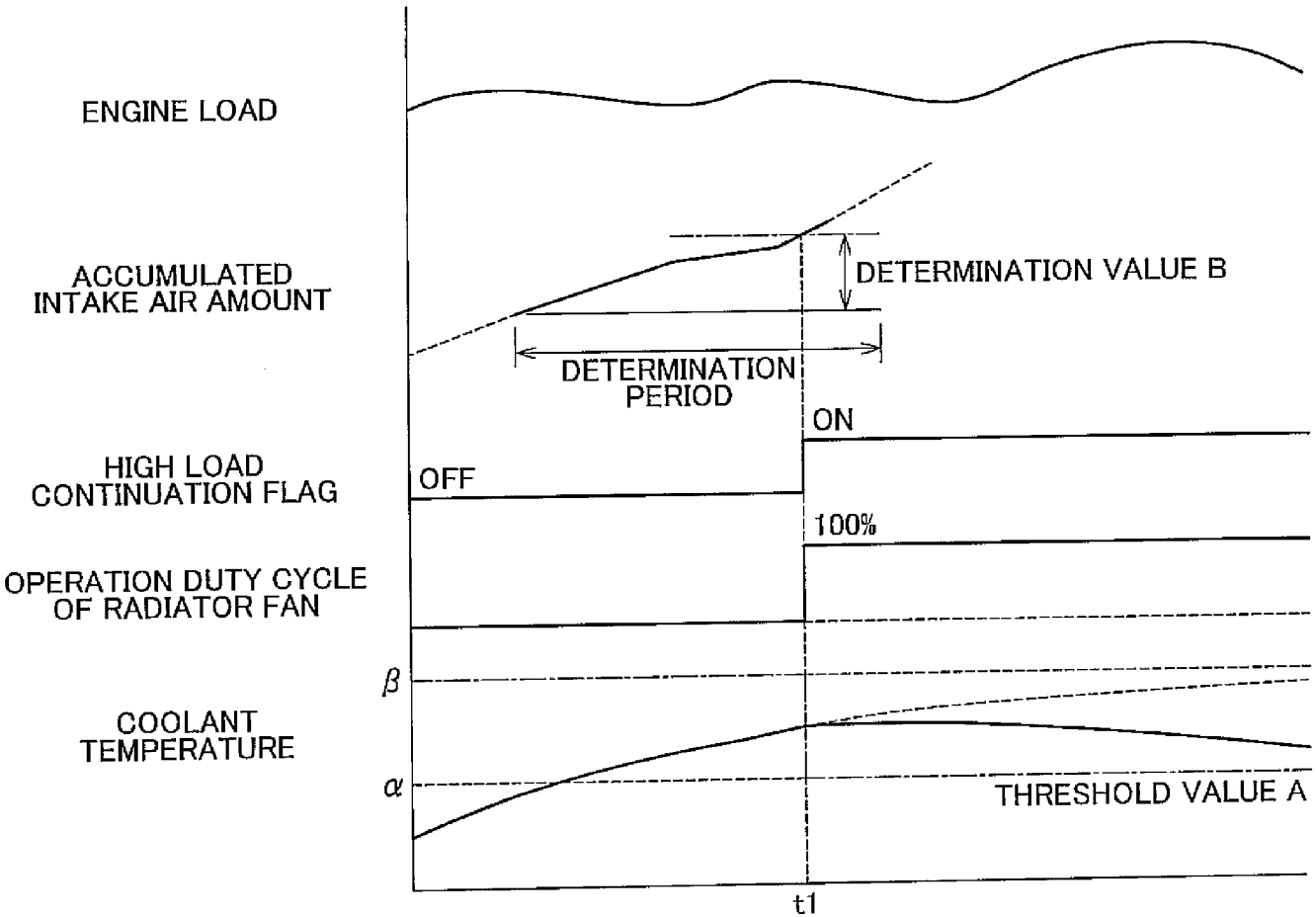
FIG. 2 is a time chart showing a control mode executed by the cooling apparatus according to the embodiment in comparison with a control mode executed by a cooling apparatus in related art.

FIG. 2 shows a control mode according to the embodiment. As shown in FIG. 2, in the embodiment, if the accumulated intake air amount during the determination period is equal to or larger than the determination value B, and therefore, it is determined that the water-cooled engine 1 is operated under a high load, a high load continuation flag is set to ON. In addition, the threshold value A related to the control of the operation of the radiator fan 9 is changed from a value β to a value α, as shown by a chain line in FIG. 2. The value β is higher than the value α.

In the example shown in FIG. 2, at time point t1, the threshold value A is decreased to the value α, and accordingly, the coolant temperature becomes equal to or higher than the threshold value A, and thus, the operation of the radiator fan 9 is started. In this case, the operation duty cycle of the radiator fan 9 is set to "100%" at this time point, so that the radiator fan 9 is operated at the maximum output. This suppresses an increase in the coolant temperature after the time point.

In FIG. 2, dash lines show a control mode in the case where the threshold value A is fixed to the value β. As shown in FIG. 2, in this case, the coolant temperature remains lower than the threshold value A that is fixed to the value β. Therefore, although the water-cooled engine 1 is operated under a high load, the radiator fan 9 remains stopped. Accordingly, in this case, the coolant temperature continues to increase after the time point t1.

Figure 3:
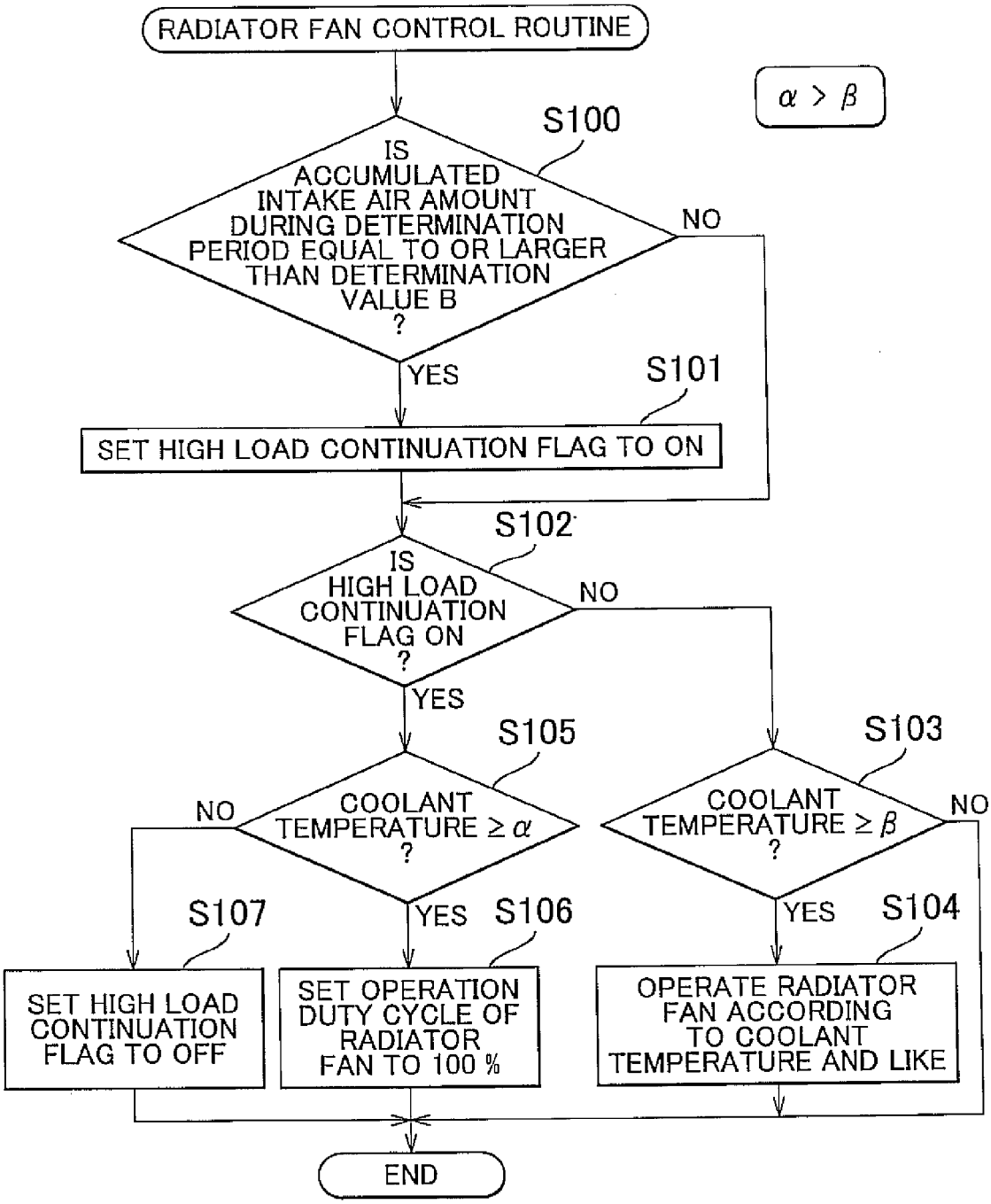
FIG. 3 is a flowchart showing steps of a radiator fan control routine employed in the embodiment.

FIG. 3 shows a flowchart of a radiator fan control routine employed in the embodiment. The routine is executed in a predetermined control cycle and is repeatedly executed by the electronic control unit 10 during the operation of the water-cooled engine 1.

When the routine is started, first, in step S100, it is determined whether the water-cooled engine 1 is operated under a high load, that is, it is determined whether the accumulated intake air amount during the determination period is equal to or larger than the determination value B. If the accumulated intake air amount during the determination period is equal to or larger than the determination value B (YES in S100), the high load continuation flag is set to ON in step S101, and the routine proceeds to step S102. If the accumulated intake air amount during the determination period is smaller than the determination value B (NO in S100), the routine proceeds to step S102 without executing any process.

When the routine proceeds to step S102, it is determined whether the high load continuation flag is ON in step S102. If the high load continuation flag is not ON (NO in S102), the routine proceeds to step S103. If the high load continuation flag is ON (YES in S102), the routine proceeds to step S105.

When the routine proceeds to step S103, it is determined whether the coolant temperature is equal to or higher than the value β in step S103. If the coolant temperature is equal to or higher than the value β (YES in S103), the radiator fan 9 is operated according to the coolant temperature, an air conditioner load, and the like in S104, and then, the current routine ends. If the coolant temperature is lower than the value β (NO in S103), the current routine ends without operating the radiator fan 9.

When the routine proceeds to step S105, it is determined whether the coolant temperature is equal to or higher than the value α that is lower than the value β in step S105. If the coolant temperature is equal to or higher than the value α (YES in S105), the radiator fan 9 is operated at the operation duty cycle of "100%" in step S106, and then, the routine ends. If the coolant temperature is lower than the value α (NO in S105), the high load continuation flag is set to OFF in step S107, and the current routine ends without operating the radiator fan 9.

In the above-described embodiment, the electronic control unit 10 may be regarded as a determination portion and a setting portion. With the cooling apparatus for the water-cooled engine according to the embodiment, it is possible to obtain the following advantageous effects.

(1) In the embodiment, the electronic control unit 10 determines whether the water-cooled engine 1 is operated under a high load. If it is determined that the water-cooled engine 1 is operated under a high load, the threshold value A of the coolant temperature, which is related to the operation of the radiator fan 9, is set to a value lower than a normal threshold value, at the time point at which it is determined that the water-cooled engine 1 is operated under a high load. Accordingly, if it is determined that the water-cooled engine 1 is operated under a high load, the electronic control unit 10 sets the operation rate of the radiator fan 9 at the time point at which it is determined that the water-cooled engine 1 is operated under a high load, to a value higher than a normal operation rate at the same coolant temperature as a coolant temperature at the time point. The radiator fan 9 continues to be operated at the set operation rate until the coolant temperature becomes lower than the threshold value A that is set to the value lower than the normal threshold value. This signifies that, in the embodiment, if it is determined that the water-cooled engine 1 is operated under a high load, a target cooling temperature of the coolant is set to a value lower than a normal target cooling temperature, at the time point at which it is determined that the water-cooled engine 1 is operated under a high load. In the embodiment, if the water-cooled engine 1 is operated under a high load, the operation of the radiator fan 9 is started at a coolant temperature lower than a coolant temperature at which the operation of the radiator fan 9 is normally started. Thus, when there is a possibility that the water-cooled engine 1 will be restarted in a high temperature condition after the water-cooled engine 1 is operated under a high load, it is possible to decrease in advance the temperatures of oil and coolant for the water-cooled engine 1 during the operation of the water-cooled engine 1. Accordingly, in the embodiment, it is possible to effectively improve the startability of the water-cooled engine 1 when the water-cooled engine 1 is restarted immediately after the water-cooled engine 1 has been operated under a high load.

(2) In the embodiment, when there is a possibility that the water-cooled engine 1 will be restarted in a high temperature condition, the temperatures of oil and coolant for the water-cooled engine 1 are decreased in advance before the restart of the water-cooled engine 1, by increasing the operation rate of the radiator fan 9 during the operation of the water-cooled engine 1. It is conceivable to operate the radiator fan 9 after the water-cooled engine 1 is stopped. In this case as well, it may be possible to decrease in advance the temperatures of oil and coolant before the restart of the water-cooled engine 1, and therefore, it may be possible to improve the restartability. However, when the water-cooled engine 1 is in a stopped state, operations of an alternator and a generator are also stopped. Therefore, if the radiator fan 9 is operated in this situation, there is a concern that the water-cooled engine 1 cannot be restarted due to a decrease in a power-feeding ability, which is caused by discharge of a battery. In contrast, in the embodiment, such a concern is eliminated, because the radiator fan 9 is operated at a high operation rate during the operation of the water-cooled engine 1.

The above-described embodiment may be modified as follows. In the embodiment, it is determined whether the water-cooled engine 1 is operated under a high load, based on the accumulated intake air amount during the determination period. However, the determination may be performed in other manners. For example, it may be determined whether the water-cooled engine 1 is operated under a high load, based on an accumulated fuel injection amount during a determination period. Also, it may be determined whether the water-cooled engine 1 is operated under a high load, based on the length of a period during which the operating state of the water-cooled engine 1 is in a high-load high-rotational speed region. Further, information on a road on which the vehicle is traveling may be acquired from a car navigation system, and it may be determined that the water-cooled engine 1 is operated under a high load when the vehicle is traveling on an upward slope for a certain period or longer.

Figure 4:
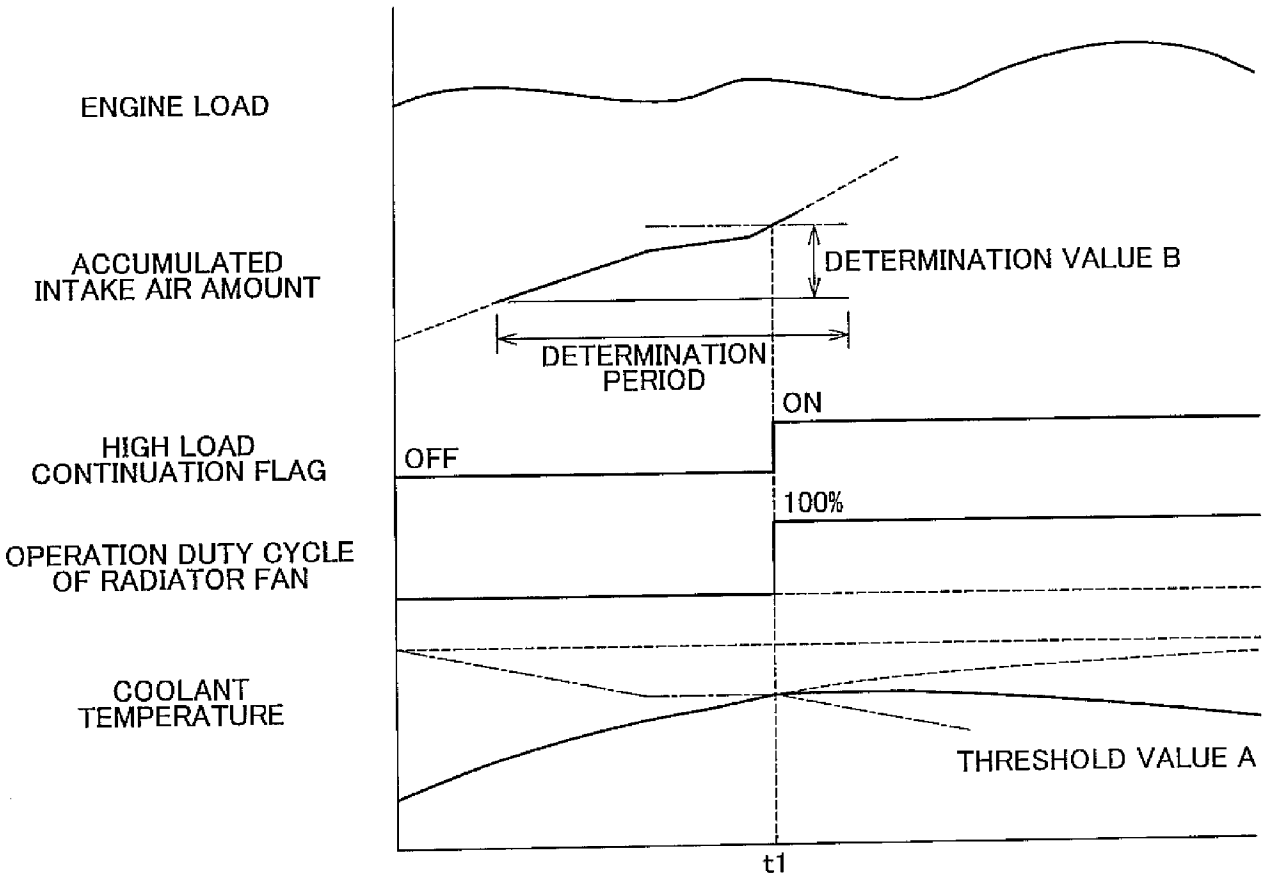
FIG. 4 shows an example in which a threshold value of a coolant temperature, which is related to the control of operation of a radiator fan, continuously decreases as the load of a water-cooled engine increases.

In the above-described embodiment, the threshold value A of the coolant temperature related to the operation of the radiator fan 9 is changed based on whether the water-cooled engine 1 is operated under a high load. However, the threshold value A may be changed continuously according to the load of the water-cooled engine 1. A chain line in FIG. 4 shows an example in which the threshold value A continuously decreases as the load of the water-cooled engine 1 increases. The threshold value A may be changed in a stepwise manner according to the load of the water-cooled engine 1. In these cases as well, it is possible to effectively improve the startability of the water-cooled engine 1 when the water-cooled engine 1 is restarted immediately after the water-cooled engine 1 has been operated under a high load, as long as the threshold value A is set to decrease as the load of the water-cooled engine 1 increases.

In the above-described embodiment, the operation rate of the radiator fan 9 at the time point, at which it is determined that the water-cooled engine 1 is operated under a high load, is made higher than the normal operation rate at the same coolant temperature as a coolant temperature at the time point, by decreasing the threshold value of the coolant temperature related to the operation of the radiator fan 9. However, the operation rate may be increased in other manners. For example, in the case where the operation duty cycle of the radiator fan 9 is variably set according to the cooling temperature, the operation rate of the radiator fan 9 may be increased by setting the operation duty cycle at the time point at which it is determined that the water-cooled engine 1 is operated under a high load, to a value higher than a normal operation duty cycle at the same coolant temperature as a coolant temperature at the time point. Also, in the case where the radiator fan 9 is intermittently operated, the operation rate of the radiator fan 9 may be increased by making time intervals, at which the radiator fan 9 is operated, shorter than normal time intervals.

What is claimed is:

1. A cooling apparatus for a water-cooled engine, comprising:

a radiator that cools coolant that has been circulated in the engine;

a radiator fan that delivers air to the radiator;

a determination portion that determines whether the engine is operated under a high load that results in a generation of fuel vapor when the engine is stopped and then restarted; and a setting portion, wherein when the determination portion determines that the engine is operated under the high load, the setting portion sets an operation duty cycle of the radiator fan at 100% at a time point at which the determination portion determines that the engine is operated under the high load.

2. The cooling apparatus according to claim 1, wherein the determination portion determines that the engine is operated under the high load that results in the generation of fuel vapor when the engine is stopped and then restarted, when an accumulated amount of air taken into the engine during a predetermined determination period is equal to or larger than a predetermined determination value.

3. A cooling apparatus for a water-cooled engine, comprising:

a radiator that cools coolant that has been circulated in the engine;

a radiator fan that delivers air to the radiator;

a radiator fan control portion that operates the radiator fan on a condition that a temperature of the coolant for the engine is equal to or higher than a threshold value;

a determination portion that determines whether the engine is operated under a high load that results in a generation of fuel vapor when the engine is stopped and then restarted; and a setting portion, wherein when the determination portion determines that the engine is operated under the high load, the setting portion sets the threshold value to a value lower than a normal threshold value for a normal high load operation, at a time point at which the determination portion determines that the engine is operated under the high load;

wherein the determination portion determines that the engine is operated under the high load that results in the generation of fuel vapor when the engine is stopped and then restarted, when an accumulated amount of air taken into the engine during a predetermined determination period is equal to or larger than a predetermined determination value.

4. The cooling apparatus according to claim 3, wherein when the determination portion determines that the engine is operated under the high load, the setting portion sets an operation duty cycle of the radiator fan to 100% at the time point at which the determination portion determines that the engine is operated under the high load, and the radiator fan control portion operates the radiator fan at the operation duty cycle of 100% on a condition that the temperature of the coolant is equal to or higher than the threshold value that is set to the value lower than the normal threshold value.

5. A cooling apparatus for a water-cooled engine, comprising:

a radiator that cools coolant that has been circulated in the engine;

a radiator fan that delivers air to the radiator;

a determination portion that determines whether the engine is operated under a high load that results in a generation of fuel vapor when the engine is stopped and then restarted; and a setting portion, wherein when the determination portion determines that the engine is operated under the high load, the setting portion sets a target cooling temperature of the coolant to a value lower than a normal target cooling temperature for a normal high load operation, at a time point at which the determination portion determines that the engine is operated under the high load;

wherein the determination portion determines that the engine is operated under the high load that results in the generation of fuel vapor when the engine is stopped and then restarted, when an accumulated amount of air taken into the engine during a predetermined determination period is equal to or larger than a predetermined determination value.

6. The cooling apparatus according to claim 5, wherein when the determination portion determines that the engine is operated under the high load, the setting portion sets an operation duty cycle of the radiator fan to 100% at the time point at which the determination portion determines that the engine is operated under the high load.

7. A method of controlling a cooling apparatus for a water-cooled engine, which includes a radiator that cools coolant that has been circulated in the engine; and a radiator fan that delivers air to the radiator, the method comprising:

determining whether the engine is operated under a high load that results in a generation of fuel vapor when the engine is stopped and then restarted;

setting a coolant temperature threshold value, which is related to a control of operation of the radiator fan, to a value lower than a normal threshold value for a normal high load operation, at a time point at which it is determined that the engine is operated under the high load, when it is determined that the engine is operated under the high load; and operating the radiator fan on a condition that a temperature of the coolant is equal to or higher than the coolant temperature threshold value that is set to the value lower than the normal threshold value for the normal high load operation, when it is determined that the engine is operated under the high load;

wherein the determination that the engine is operated under the high load that results in the generation of fuel vapor when the engine is stopped and then restarted, when an accumulated amount of air taken into the engine during a predetermined determination period is equal to or larger than a predetermined determination value.

8. The method according to claim 7, wherein in operating the radiator fan, the radiator fan is operated at an operation duty cycle of 100% on the condition that the temperature of the coolant is equal to or higher than the coolant temperature threshold value that is set to the value lower than the normal threshold value, when it is determined that the engine is operated under the high load.

* * * * *